US006257507B1

(12) United States Patent
Morell et al.

(10) Patent No.: US 6,257,507 B1
(45) Date of Patent: Jul. 10, 2001

(54) PUMP NOZZLE OF A TYPE WITH AN OPEN INJECTION NOZZLE

(75) Inventors: Josef Morell, Mauerbach; Harald Schmidt; Anton Dolenc, both of Vienna, all of (AT)

(73) Assignee: Steyr-Daimler-Puch Aktiengesellschaft, Vienna (AT)

( * ) Notice: Subject to any disclaimer, the term of this patent is extended or adjusted under 35 U.S.C. 154(b) by 0 days.

(21) Appl. No.: 09/582,807

(22) PCT Filed: Dec. 23, 1998

(86) PCT No.: PCT/AT98/00322

§ 371 Date: Aug. 29, 2000

§ 102(e) Date: Aug. 29, 2000

(87) PCT Pub. No.: WO99/34114

PCT Pub. Date: Jul. 8, 1999

(30) Foreign Application Priority Data

Dec. 29, 1997 (DE) ..... 197 58 066

(51) Int. Cl.[7] ..... F02M 59/00

(52) U.S. Cl. ..... 239/533.2; 239/533.5; 239/584

(58) Field of Search ..... 239/88–96, 533.1, 239/533.2, 533.3, 533.4, 533.5, 533.6, 533.7, 533.8, 533.9, 583, 584; 251/63.4

(56) References Cited

U.S. PATENT DOCUMENTS 5,076,240 12/1991 Perr .

FOREIGN PATENT DOCUMENTS 4432686 5/1996 (DE) .
0460693 12/1991 (EP) .
0470348 2/1992 (EP) .
2003550 3/1979 (GB) .

*Primary Examiner*—Lisa Ann Douglas
(74) *Attorney, Agent, or Firm*—Bachman & LaPointe, P.C.

(57) ABSTRACT

A unit fuel injector of the type with an open injector comprises an injector body (1) with an axial space (4), which ends in an injector cap (3), an injection plunger (15) guided in the axial space and serving as a closing-off element, which injection plunger forms in the axial space a pressure space (23) from which the injection bores (60, 61) of an upper row (60) and a lower row (61) extend. To allow the injector cross section to be adapted to all operating states, the injection plunger (15) has an axial bore (30), in which a coaxial plunger needle (31) is guided in the longitudinal direction of the injector, the needle part (32) of which needle interacts with a seat (62) formed by the interior of the injector cap (3) and arranged beneath the upper row of injection bores (60), and above the plunger part (32) of the plunger needle (31) there is provided a compression spring (35) acting on it in a downward direction, and the plunger needle forms beneath its plunger part (32) in the axial bore (30) a control chamber (50), which can be fed by a control medium which raises the plunger needle (31) against the force of the compression spring (35) with respect to the injection plunger (15).

10 Claims, 4 Drawing Sheets

PUMP NOZZLE OF A TYPE WITH AN OPEN INJECTION NOZZLE

BACKGROUND OF THE INVENTION

The invention relates to a unit fuel injector of the type with an open injector, comprising an injector body with an axial space, which ends in an injector cap with injection bores, comprising an injection plunger guided in the axial space and serving as a closing-off element, which injection plunger bounds in the axial space a pressure space from which the injection bores extend.

A unit fuel injector of the type with an open injector is known, for example, from EP 460 693 A1. It has the special feature that the injection plunger is a pumping element and closing element at the same time. These unit fuel injectors also have the problem when they are used in high-power diesel engines—which are usually supercharged—with respect to the minimizing of consumption and emissions that the injection requirements differ considerably between idling and full load.

During idling and at low compression pressure, the rate of injection is low and the ignition delay is long. During the ignition delay, as little fuel as possible is to be injected as slowly as possible, and nevertheless atomized well. At full load and a high engine speed, on the other hand, the rate of injection is great—in the case of supercharged high-power engines even particularly great—and the duration of injection is to be as short as possible, since only a limited crank angle is of course available for the injection. All in all, optimizing combustion with regard to consumption and emissions requires a uniform distribution of the fuel in the combustion chamber and defined atomization.

The greater the differences in rates and speeds, the more difficult it is to optimize combustion with constant injector cross sections. Although it is known from EP 470 348 A1 and DE 44 32 686 C2 to provide a number of rows of injection bores and two concentric plunger needles in unit fuel injectors, in which the pumping element and closing element are separate, in order in this way to be able to adapt the cross section of the injector to the operating state, these solutions concern only the valve function and consequently cannot be transferred to the open unit fuel injectors of the generic type. Due to their special structural design, there is a different relationship between the cross section of the injector and the injection pressure.

SUMMARY OF THE INVENTION

The invention is therefore based on the object of being able to adapt the cross section of the injector and the delivery rate to the respective operating state even in the case of unit fuel injectors of the generic type. Adaptation is to be understood here as meaning both the control during operation and the design.

This is achieved according to the invention by the features that a) the injector cap (3) has a first group (60) and a second group (61) of injection bores (60, 61), of which the first group (60) is assigned to the injection plunger (15) and the second group (61) can be closed off separately from the first, b) the injection plunger (15) has an axial bore (30), in which a plunger needle (31) is guided, the needle part of which interacts with a seat (21; 62; 72) formed in the interior of the injector cap (3), the second group of injection bores (61) being assigned to the plunger needle (31), c) the plunger needle (31) has a plunger part (32) on which a compression spring (35) acts in a downward direction and which bounds a control chamber (50) in the axial bore (30), d) the control chamber (50) can be fed a control medium, which raises the plunger needle (31) against the force of the compression spring (35) with respect to the injection plunger (15), so that said needle follows the movement of said plunger.

The two groups of injection bores can be closed off separately, the first by the injection plunger, the second by the plunger needle, which in certain load states also acts as the injection plunger. In these states, not only the injector cross section but also the pump characteristics are changed. This is possible only because both closing elements are pumping elements.

During idling and at low load, the plunger needle remains closed. As a result, in this operating state the volume of the delivery space is initially small. Furthermore, the effective area of the injection plunger is only that of a circular ring and is therefore smaller, which means a relatively higher injection pressure, in particular during hydrostatic pressure transmission from the pump drive to the injection plunger. Finally, the injector cross section is only the sum of the cross sections of the one row of injection bores. The injection bores may be relatively small, in order to achieve a long duration of injection. This makes the injection pressure high, which improves the atomization of the fuel.

At higher part load or full load and a high engine speed, the plunger needle is drawn into the injection plunger. As a result, the injection bores of the further row are also open, thereby increasing the available cross section of the injection bores. Furthermore, the volume of the delivery space and the plunger area—now comprising the area of the injection plunger and the needle—is greater. This means a considerably greater delivery rate per unit of time at the same engine speed. There is consequently a threefold effect.

All this is achieved with relatively low additional technical outlay. What is more, the control is also not sophisticated, since it only needs two positions of the plunger needle. Consequently, exact positioning of a final control element is not required. The engine controller only has to be provided with a threshold value or a curve in the characteristic map, at which value or curve a switch is made from one mode to the other. All in all, it is possible in this way to adjust both the delivery rate and the effective injector cross sections, even independently of each other.

In an advantageous design, the feeding of the control medium to the control chamber takes place through a feeding bore in the injector body and a branch bore in the injection plunger, with a longitudinal groove being provided in the injector body or in the injection plunger. Consequently, the problem of continuously varying the pressure in the control chamber moving with the injection plunger is elegantly solved.

A further simplification is obtained if the injection plunger has a stop fixing the uppermost position of the plunger needle. As a result, vibrations of the plunger needle are avoided and the control pressure does not need to be maintained exactly. As a result, the unit fuel injector is insensitive to pressure losses in the event of wear.

In an advantageous development, the injection plunger has at its outer wall an annular space, which connects the fuel feed to a return flow when the injection plunger is closed. As a result, once injection has been completed the excess pressure in the fuel feed line can be relieved and flushing and cooling can be carried out at the same time, without colliding with the feed of control medium.

To allow the entire engine characteristic map to be covered optimally and the limits between the two ranges to be chosen optimally, it has proven to be advantageous to choose the ratio of the diameters of the injection plunger and needle part of the plunger needle to be in the range between 1:2 and 1:3, the diameter of the first group of injection bores to be less than that of the second group of injection bores, and the ratio of the cross section of all the injection bores of the first group to that of all the injection bores of the second group to be greater than the ratio of the effective cross sections of the injection plunger and injection needle.

The shape and design of the closing elements, as well as the grouping and arrangement of the injection bores, may vary considerably within the scope of the invention and be adapted to the requirements of the pumping function. A particularly advantageous solution is that the injector cap has on the inside a conical seat and the second group of injection bores is arranged beneath the first group of injection bores, the groups of injection bores respectively beginning at the same height.

BRIEF DESCRIPTION OF THE DRAWINGS

The invention is described and explained below on the basis of illustrations of a preferred exemplary embodiment. In the figures.

DETAILED DESCRIPTION OF THE PREFERRED EMBODIMENT

Figure 1:
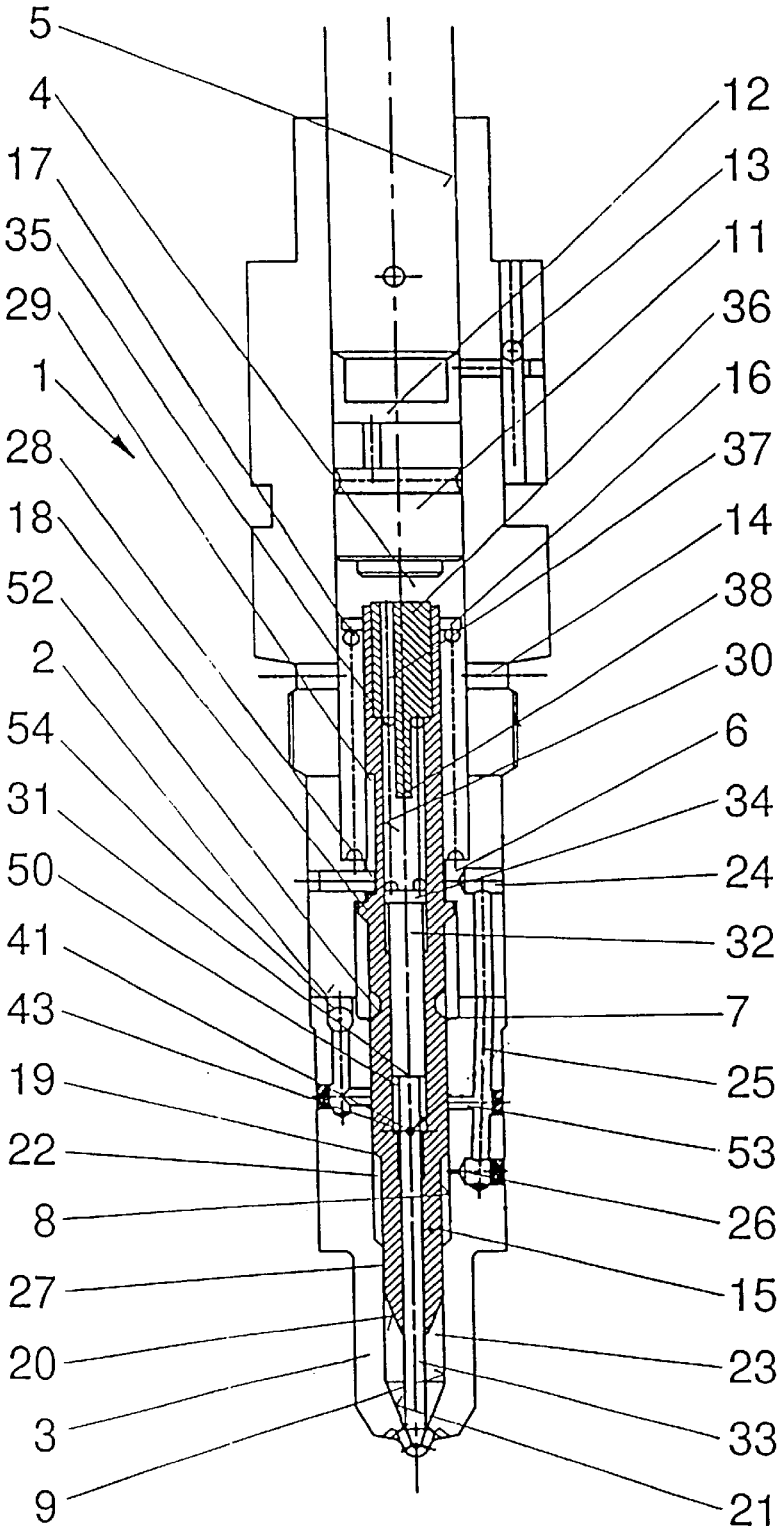
FIG. 1 shows the pumping injector in a first operating position.

In FIG. 1, the entire injector body is denoted in a summarizing way by 1. It may be composed of one or more parts; in the present example it is divided along its radial surface 2 for production reasons. At the bottom, it goes over into an injector cap 3 and contains over its entire length an axial space 4 which is accessible from the top. This space begins at the top with a bore 5, which is interrupted at a shoulder-like constriction 6 and further down forms a first cylindrical bore 8 and a smaller second cylindrical bore 9.

Right at the top in the interior of the axial space 4, a drive plunger is guided in a sealed and movable manner; it is driven for example by a camshaft (not represented). This is followed by an intermediate plunger 11, which together with the drive plunger forms an injection-adjusting space 12, which leads via a connecting bore 13 to the injection-adjusting control (not represented). 14 denotes an only indicated return flow, which connects the axial space 4 to the return flow of the injection system.

The intermediate plunger 11 acts on an injection plunger 15. At the top, it has a collar 16, on which there acts from below a restoring spring 17, designed as a compression spring, the lower end of which is supported on the constriction 6. The injection plunger 15 is consequently pressed in an upward direction by the restoring spring 17, a stop bead 18 bearing against the constriction 6 when at rest. Further below, the injection plunger 15 fits into the first cylindrical bore 8, which reaches in a downward direction from a shoulder 7, then fits into the smaller second cylindrical bore 9 and ends with an end cone 20. At the end of the injection, the end cone 20 rests on a seating cone 21 of the injector cap. Between the injection plunger 15, the first cylindrical bore 8 and a pressure shoulder 19 of the injection plunger 15 there is formed a metering space 22 and further below, between the second cylindrical bore 9, the end cone 20 and the seating cone 21, there is formed a pressure space 23. At 24, fuel is introduced at the pressure of a delivery pump (not represented) into the injector body 1 and passes via a longitudinal bore 25 and a feed opening 26 into the metering space 22. From the latter, it flows during the injection through a narrow annular passage 27 into the pressure space 23 and from there via injection bores into the combustion chamber of the engine. Provided in the injector body 1 is an inwardly protruding anti-twisting pin 28, which interacts with a vertical guiding groove 29 on the injection plunger 15.

In the injection plunger 15 there is then an axial bore 30, in which a plunger needle 31 is guided in the longitudinal direction. It comprises an upper plunger part 32 and a lower needle part 33. On the plunger part 32 there rests a small pressure plate 34, on which a compression spring 35 acts in a downward direction. The upper end of said spring is supported on a plug 36, which is pressed or screwed into the injection plunger 15. The plug 36 has an axial pressure-equalizing bore 37 and forms a stop 38 when the small pressure plate 34 is raised—as still to be described.

Figure 2:
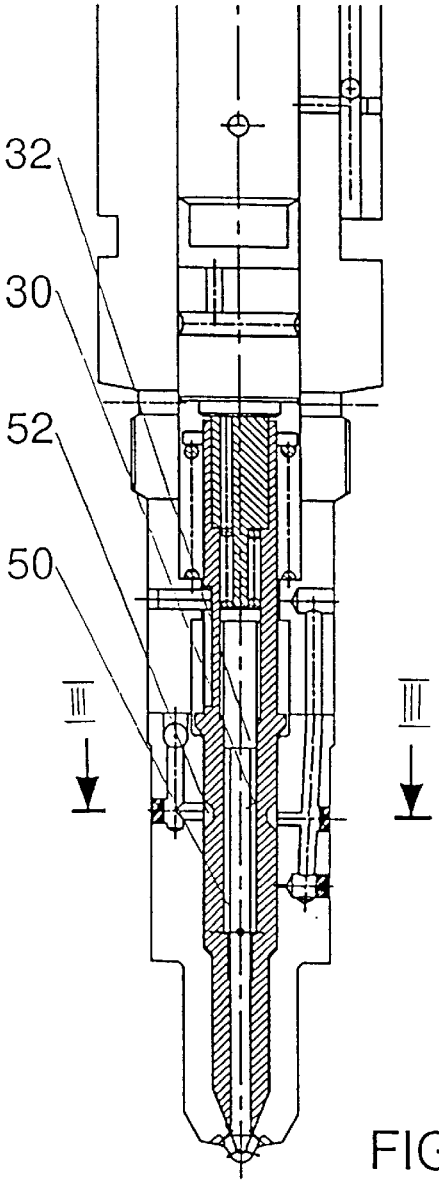
FIG. 2 shows the same, in a second operating position.
Figure 6:
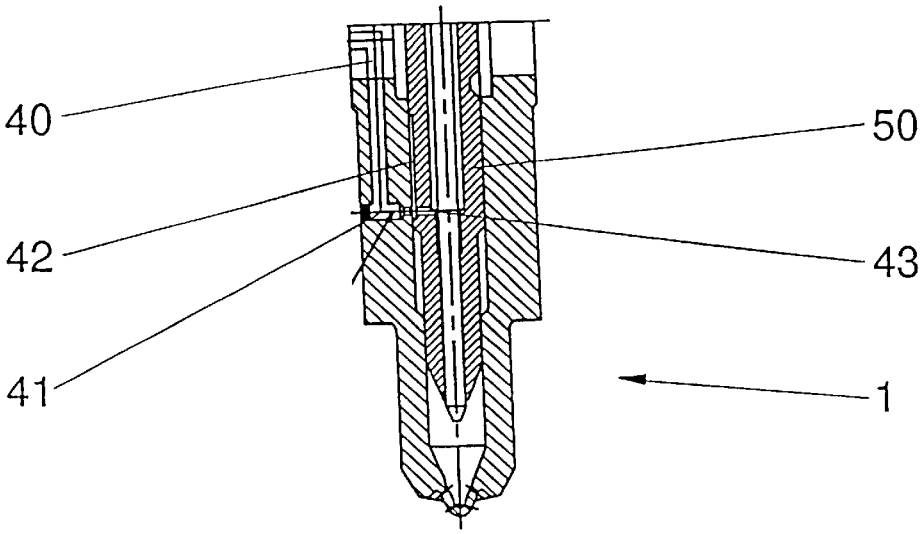
FIG. 6 shows a longitudinal section along VI—VI in FIG. 4.

In FIG. 2 it can be seen better that a control chamber 50 is formed between the plunger part 32 and the axial bore 30. Control medium is fed to the injector body 1 via an opening 40 (see FIG. 6) and passes via a feed bore 41 in the injector body 1 into the central space and from there directly or—depending on the position of the injection plunger—via a longitudinal groove 42, which may be machined both into the injection plunger 15 and into the inner wall of the injector body, through a branch bore 43 into the control chamber 50.

Figure 3:
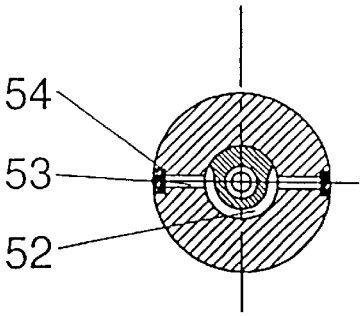
FIG. 3 shows a cross section along III—III in FIG. 2.
Figure 5:
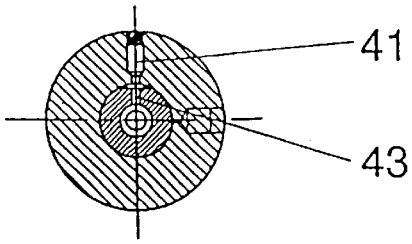
FIG. 5 shows a cross section along V—V in FIG. 4.

In FIG. 3 it can be seen that the injection plunger 15 has at a certain height and over part of its circumference a milled relief, which forms an annular space 52. This establishes the connection between a flushing bore 53 and a flushing channel 54, which leads into the axial space 4. The latter is connected to the return flow 14.

Figure 7:
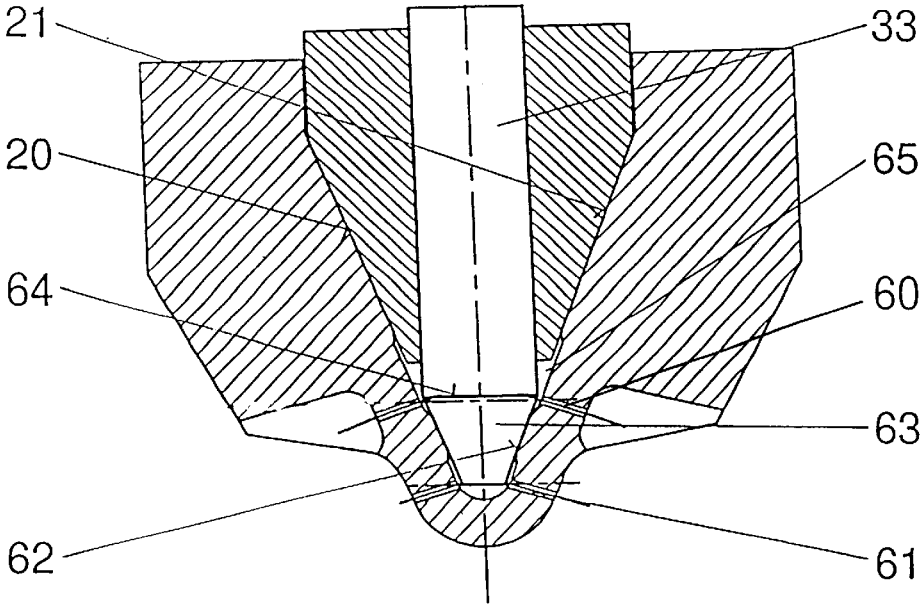
FIG. 7 shows detail A in FIG. 1, enlarged.
Figure 8:
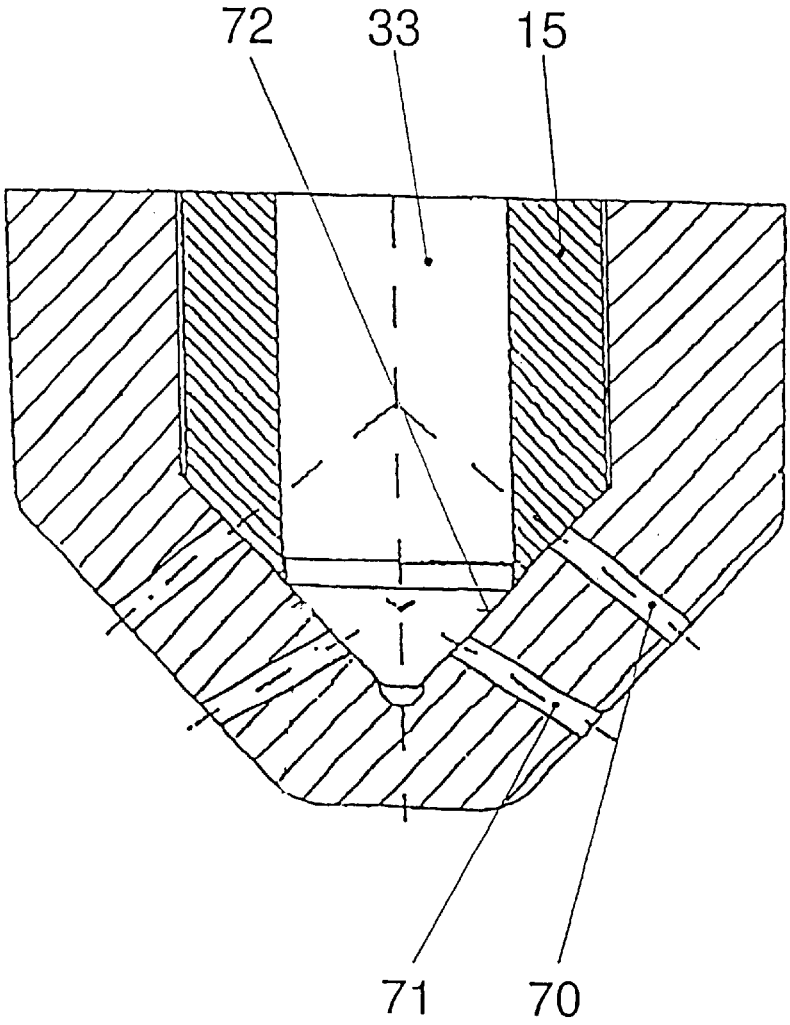
FIG. 8 shows a variant of detail A in FIG. 1, enlarged.

In FIG. 7, the lower end of the injector cap is shown enlarged. It has an upper row of injection bores 60 and a lower row of injection bores 61, which are arranged at a certain distance from one another. The injection bores may, within the scope of the invention, be designed very differently with regard to arrangement, length, cross section and entry. Formed between the injection bores of the two rows 60, 61 is a seat 62, on which a cone 63 of the needle part 33 rests. The transition to the cone 63 takes place at an edge 64, which lies somewhat higher than the entry of the injection bores of the upper row when the plunger needle is closed. To protect the injection bores and for machining reasons, the parts of the seating cone 21 in which the injection bores open out have been withdrawn, approximately at 65. In another embodiment according to FIG. 8, seating-hole-drilled injection bores 70, 71 have been made, extending from a common seat 72.

Figure 4:
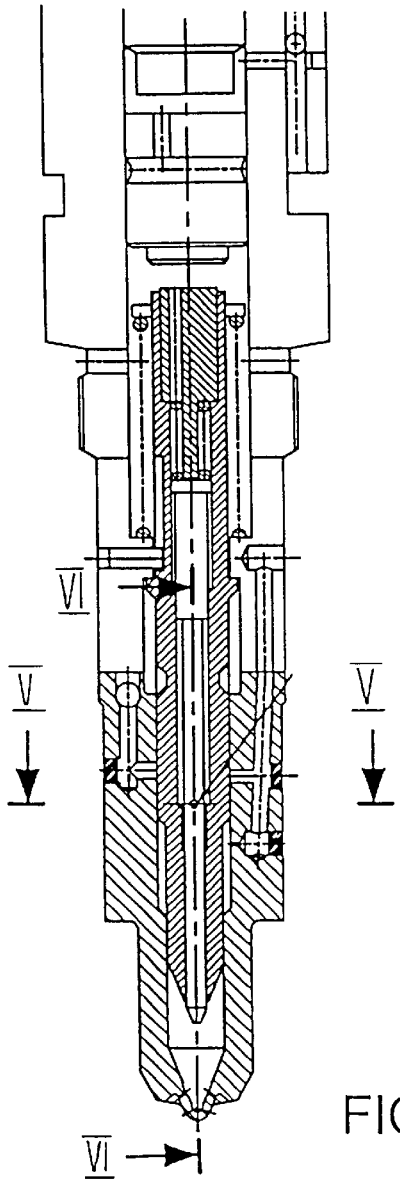
FIG. 4 shows the same, in a third working position.

The operating mode is now explained with reference to FIGS. 1, 2 and 4:

FIG. 1 shows the unit fuel injector after a completed metering stroke, at the end of the upward movement of the injection plunger 15 for idling or low load. In this operating state, the control chamber 50 is pressureless, for which reason the plunger needle 31 has not taken part in the upward movement of the injection plunger; in spite of the upward-moving injection plunger 15, it has been kept closed by the compression spring 35. If the injection plunger 15 is then moved in a downward direction into the position shown in FIG. 2, the fuel is injected from the pressure shoulder 19 out of the metering space 22 through the annular passage 27 into the pressure space 23 and from there only from the end cone 20 of the injection plunger through the injection bores 60 of the upper row into the combustion chamber of the engine. If the control chamber 50 continues to remain pressureless, the injection plunger is moved in an upward direction again on its own, back into the position of FIG. 1, leaving the plunger needle 13 behind in the closed position.

If, however, control pressure is applied via the feed line 40, 41, this pressure passes via the bores 41, 43, in every position of the injection plunger 15 because of the longitudinal groove 42, into the control chamber 50. This exerts an upwardly directed force onto the plunger part 32 of the plunger needle 31. If the injection plunger 15 is then moved in an upward direction, the pressure of the control medium in the control chamber 50 overcomes the force of the compression spring 35 and the plunger needle 31 moves in an upward direction with the injection plunger 15. This position is shown in FIG. 3. Since the plunger needle has now also been drawn in, the volume of the pressure space 23 is greater, as is the common area of the injection plunger and plunger needle. If both are then moved in a downward direction (the plunger area is consequently greater), the injection takes place through the injection bores 60, 61 of both rows. In this case, the rate may also be greater, if so desired by the rate control.

By coordinating the effective areas of the injection plunger and plunger needle—a ratio in the range specified is advantageous—and the cross-sectional areas of the injection bores 60, 61 of the two rows, the spray pattern and course of combustion can be optimized. At low load, injection takes place only through the injection bores 60 of the upper row, for which reason their diameter may be smaller than that of the lower row 61. For optimum coordination, furthermore, the ratio of the cross section of all the injection bores (60) of the upper row to that of all the injection bores of the lower row (61) may be greater than the ratio of the effective cross sections of the injection plunger (15) and plunger needle.

What is claimed is:

1. A unit fuel injector of the type with an open injector having a pump and an injector in the unit, comprising an injector body (1) with an axial space (4), which ends in an injector cap (3) with injection bores, comprising an injection plunger (15) guided in the axial space and serving as a closing-off element, which injection plunger bounds in the axial space a pressure space (23) from which the injection bores extend, wherein a) the injector cap (3) has a first group (60) and a second group (61) of injection bores (60, 61), of which the first group (60) is associated with the injection plunger (15) and the second group (61) can be closed off separately from the first, b) the injection plunger (15) has an axial bore (30), in which a plunger needle (31) is guided, a needle part of which interacts with a seat (21; 62; 72) formed in the interior of the injector cap (3), the second group of injection bores (61) is associated with the plunger needle (31), c) the plunger needle (31) has a plunger part (32) or which a compression spring (35) acts in a downward direction and which defines a control chamber (50) in the axial bore (30), d) the control chamber (50) is fed a control medium indicating load, which raises the plunger needle (131) against the force of the compression spring (35) with respect to the injection plunger (15), so that said needle follows the movement of said plunger.

2. The unit fuel injector as claimed in claim 1, wherein the feeding of the control medium to the control chamber (50) takes place through a feeding bore (41) in the injector body (1) and a branch bore (43) in the injection plunger (15), with a longitudinal groove (42) being provided in the injector body (1) or in the injection plunger (15).

3. The unit fuel injector as claimed in claim 1, wherein the injection plunger (15) has a stop (38) fixing the uppermost position of the plunger needle (31).

4. The unit fuel injector as claimed in claim 1, wherein the injection plunger (15) has at its outer wall an annular space, which connects a fuel feed (24) to a return flow (14) when the injection plunger is closed.

5. The unit fuel injector as claimed in claim 1, wherein the ratio of the diameters of the injection plunger (15) and needle part (33) of the plunger needle (31) is in the range between 1:2 and 1:3.5.

6. The unit fuel injector as claimed in claim 1, wherein the diameter of the first group of injection bores (60) is less than that of the second group of injection bores (61).

7. The unit fuel injector as claimed in claim 1, wherein the ratio of the cross section of all the injection bores (60) of the first group to that of all the injection bores of the second group (61) is greater than the ratio of the effective cross sections of the injection plunger (15) and plunger needle (31).

8. The unit fuel injector as claimed in claim 1, wherein the injector cap (3) has on the inside a conical seat (21) and the second group (61) of injection bores (61) is arranged beneath the first group (60) of injection bores (60), the groups of injection bores (60, 61) respectively beginning at the same height.

9. The unit fuel injector as claimed in claim 8, wherein in the interior of the injector cap (3) there is formed the seat (21) for the injection plunger (15) and a seat (62) for the plunger needle (31), the first group of injection bores (60) being arranged beneath the seat of the injection plunger (21).

10. The unit fuel injector as claimed in claim 8, wherein in the interior of the injector cap (3) there is provided the seat (21) for the injection plunger (15) and for the plunger needle (31), from which at least one of the groups of injection bores (70, 71) extends.

* * * * *